United States Patent [19]

Libicky et al.

[11] 4,245,034

[45] Jan. 13, 1981

[54] METHOD AND APPARATUS FOR REGENERATING PHOTOGRAPHIC PROCESSING SOLUTION

[75] Inventors: Arnost Libický, Marly; Walter E. Mueller, Fribourg, both of Switzerland

[73] Assignee: Ciba-Geigy AG, Basel, Switzerland

[21] Appl. No.: 2,914

[22] Filed: Jan. 12, 1979

[30] Foreign Application Priority Data

Jan. 17, 1978 [CH] Switzerland ..... 462/78

[51] Int. Cl.[2] ..... G03C 5/30

[52] U.S. Cl. ..... 430/399; 430/265

[58] Field of Search ..... 96/50 A, 66 R; 430/399, 430/265

[56] References Cited

U.S. PATENT DOCUMENTS

| | | | |
|---|---|---|---|
| 3,828,172 | 8/1974 | Schickler | 96/50 A |
| 3,970,457 | 7/1976 | Parsonage | 96/66 R |
| 4,025,344 | 5/1977 | Allen et al. | 96/66 R |
| 4,081,280 | 3/1978 | Corluy | 96/66 R |

FOREIGN PATENT DOCUMENTS

| | | | |
|---|---|---|---|
| 1313796 | 4/1973 | United Kingdom | 96/50 A |

OTHER PUBLICATIONS

Journal of Photographic Science, vol. 12, 1964, pp. 61–70, by Carlo, "Replenishment of Solutions in Batch Processing".

*Primary Examiner*—Mary F. Downey
*Attorney, Agent, or Firm*—Harry Falber

[57] ABSTRACT

Two concentrated solutions (A and B) are used, together with diluting water (W). One concentrate, at a pH below 7, contains hydroquinone, sulphite and sodium formaldehyde bisulphite, whereas the other contains alkali, buffer substances and complexing agents if required. Both concentrates are free from bromine ions. The two concentrates are separated and a variable proportion of water is added to each at the same time as a portion of film to be developed is introduced into a developing tank (11). The concentration of regenerating mixture and the addition of water are controlled in accordance with the machine throughput, i.e. the concentration is high when the machine throughput is low and vice versa. The concentration is regulated by time-controlled proportioning pumps (5, 6, 7) and a three-way valve (8) in the line supplying water for dilution, the valve (8) conveying the water either to the processing tank (11) or back to the proportioning-pump inlet (16), depending on the position of the valve (FIG. 1).

5 Claims, 2 Drawing Figures

METHOD AND APPARATUS FOR REGENERATING PHOTOGRAPHIC PROCESSING SOLUTION

FIELD OF THE INVENTION

The invention relates to a method of regenerating and maintaining the activity of a photographic processing solution, more particularly a lith developing solution, in a continuous processing machine intermittently supplied with exposed photographic material.

When photographic materials are processed in automatic machines, care must be taken that the activity of the individual processing baths remains constant, so that the quality of processing stays constant over relatively long periods. Over a prolonged period, the activity of the bath is determined mainly by the following two factors:

(a) Chemical exhaustion due to the actual processing, and (b) Chemical changes due not to the processing but to other factors, e.g. the action of atmospheric oxygen, gradual decomposition of individual components, accumulation of by-products, etc.

Change (a) usually depends directly on the amount of processed material, whereas change (b) is generally independent of the amount of processed material but depends on the time in use and the bath temperature.

In many cases, therefore, it is not sufficient to regenerate the processing bath by making up used components in proportion to the amount of processed material. On the contrary, particularly after relatively long inoperative periods, it is also necessary to allow for the age of the bath liquor and renew any components which have deteriorated, either spontaneously or through action of atmospheric oxygen.

Variations during operating occur particularly in those processing baths which contain substances having an action based on reduction and oxidation. Photographic developing baths are particularly easy to oxidize by atmospheric air. Another example is colour bleaching baths used in the silver colour-bleaching process, the action of the baths being dependent on the relatively sensitive redox equilibrium of the bleaching catalysts and oxidizing agents therein. It is particularly difficult to regenerate lith developing agents used to develop high-contrast materials. Apart from a single developing substance (hydroquinone), these developing agents contain only a very little sulphite and are therefore easily oxidized by atmospheric oxygen. The activity of lith developing agents is also criticaly influenced by other factors such as the pH and the instantaneous concentration of bromine ions. During the developing of photographic material, hydroquinone and sulphite are used up and bromine ions are simultaneously liberated. It is therefore particularly difficult to maintain a constant activity in the aforementioned baths, and both the changes caused by continuous developing of photographic material and the changes caused by variations in the time in use must be exactly compensated.

PRIOR ART

Lith developing agents are commonly regenerated by using two or more different solutions having compositions matched to one another so that, by varying the mixing ratios, all changes in activity occurring during operation can be compensated. Various methods of measurement are conventionally used for accurately determining the nature of the changes in activity and regenerating the bath by adding suitable components. The following two fundamentally different methods are used:

1. Chemical analysis of bath composition and
2. Measuring the area and blackening of the developed material.

Both methods are relatively expensive and are not of real value unless they can be performed with sufficient accuracy. The first method and its use in an automatic lith developing-agent regenerating system is described e.g. in German Offenlegungeschrift No. 2 119 069, and the second is described e.g. in German Offenlegungeschriften Nos. 2 343 242 and 2 343 318. In the method described in the last-mentioned publications, it is normal to use three different solutions, the total amount and proportion of the regenerating constituents being calculated from (a) the amount and blackening of the processed film material and (b) from the time during which the contents of the tank has been in use. A relatively expensive automatic measuring device is used, and the constituents are added at periodic intervals.

U.S. Pat. No. 3,162,534 discloses a method of regenerating lith developing agents wherein only two solutions are used, the less concentrated solution being added for compensation, depending on the amount of developed film and the more highly concentrated solution being used for periodically compensating the changes occurring during use. Neither solution contains hydroquinone, and consequently their activity can be maintained only for a limited time.

The normal regeneration method, more particularly in automatic developing machines, is as follows: Measured quantities of regenerated fluid are poured into the tank, either periodically or at intervals controlled in accordance with the amount of processed material, and at the same time a corresponding quantity of fluid from the tank is discharged through an overflow to a wastewater pipe. The volume of processing fluid thus remains constant during the entire period of operation and the activity is kept constant by continuously supplying the regenerator fluid.

OBJECT OF THE INVENTION

The object of the invention is to provide a particularly simple method of regenerating lith developing agents, more particularly suitable for automatic developing machines and requiring only one regenerator, containing the active components in a constant ratio. More particularly, the method according to the invention does not require any complicated methods of determining the bath composition or the area of blackened film, but is capable of maintaining the activity of the lith developing agent constant for a very long period.

SUMMARY OF THE INVENTION

In accordance with this invention therefore we provided a method of regenerating and maintaining the activity of a photographic proceeding solution in a continuous processing machine intermittently supplied with exposed photographic material, comprising adding a regenerator of concentrated substances and diluting water to the processing solution before, simultaneously or after the introduction of photographic material the proportion of concentrates in the regenerator being made higher or lower depending on whether the expected throughput of photographic material is relatively small or relatively large respectively during a given period.

In practice, the regenerator is preferably divided into two concentrated solutions, one at a pH below 7 and containing hydroquinone, sulphite and sodium formaldehyde bi-sulphite and the other at a higher pH and containing alkali, buffer substances and, if required, other components such as complexing agents and aromatic amines, both concentrates being free from bromine ions. The two concentrates are simultaneously but separately poured into the developing tank together with the water for dilution whenever a piece of photographic material for development is placed in the tank. The blackened portion of material can be determined simply by using an empirical value. The throughput is estimated from the amount of regenerator converted per unit time, relative to the contents of the processing tank.

As a result of the method according to the invention, both the concentration of bromine ions, which determine the activity of the developing solution, and the concentration of hydroquinone, which is acted upon by atmospheric oxygen, can be kept substantially constant. It is known that when exposed photographic material is developed, bromine ions are liberated in an amount proportional to the exposed area and the silver bromide present in the photographic film. Consequently, if the machine throughput is large, the developing fluid will contain a higher proportion of bromine ions unless case is taken to remove them from the fluid at the same rate as they are produced. Since the volume of replenishing liquid which is added per unit area of exposed and processed film is kept constant, the number of bromine ions generated by the developement process will be equal to the number of bromine ions removed by overflow as soon as the process has reached its equilibrium. On the other side, the concentration of hydroquinone is kept constant by variation of the replenisher concentration: with low throughput, the part of hydroquinone rendered inactive by aerial oxidation tends to be higher, whereas this part will be lower with high throughput. Accordingly a higher concentration of the replenisher has to be chosen for low throughput and, logically, a lower concentration for high throughput, the total volume of replenisher solution per unit area of exposed film being kept constant for the reasons explained above.

If the machine is long inoperative, hydroquinone is used up by atmospheric oxidation without bromine ions being simultaneously liberated. This can be compensated by adding an amount of concentrated regenerator proportional to the expected loss. If the regenerator concentrates do not contain bromine ions, the concentration of bromine ions in the developing fluid changes only very slightly, i.e. in proportion to the amount which has been discharged, and this amount can be kept very small if no diluting water is added.

If A and B are the two regenerator concentrates and W is the water for dilution, the change in concentration is preferably brought about as follows. The total amount of regenerator fluid per unit area of blackened film and the proportions of each regenerator concentrate are kept constant, the only variation being made in the amount of diluting water, depending on the proportions of the two regenerator concentrates, i.e.

$$A+B+W=\text{constant}$$

$$A:B=\text{constant}$$

Preferably the regenerator concentration is varied in steps, corresponding to the throughput. The minimum concentration, i.e. the minimum amount of concentrate in proportion to the total amount of regenerator, can be approximately 2:6, associated with a maximum throughput of 60% or more of the volume of the developing tank. The maximum concentration depends on the minimum throughput occurring in practice, e.g. approximately 10% consumption of regenerator, and can be approximately 2.5:6 to 3:6. Of course the most favourable values depend on the nature and composition of the processing solution and regenerator.

The invention also relates to a device for performing the method comprising a control system, three storage containers for the two concentrates and the diluting water, and three proportioning pumps for the concentrates and water, the pumps being connected by lines between the storage containers and the processing tank. The control system comprises first input means for inputting the area, the exposed portion and characteristic variable dependent on the nature of the photographic material, and a second input means for the expected throughput. The control system determines the amount of regenerator on each occasion from the parameters supplied by the first input means and the concentration of regenerator on each occasion from the parameters input by the second means, and actuates the proportioning pumps accordingly.

BRIEF DESCRIPTION OF THE DRAWINGS

A method and a device according to the invention will now be described in detail with reference to the drawings, in which.

Figure 1:
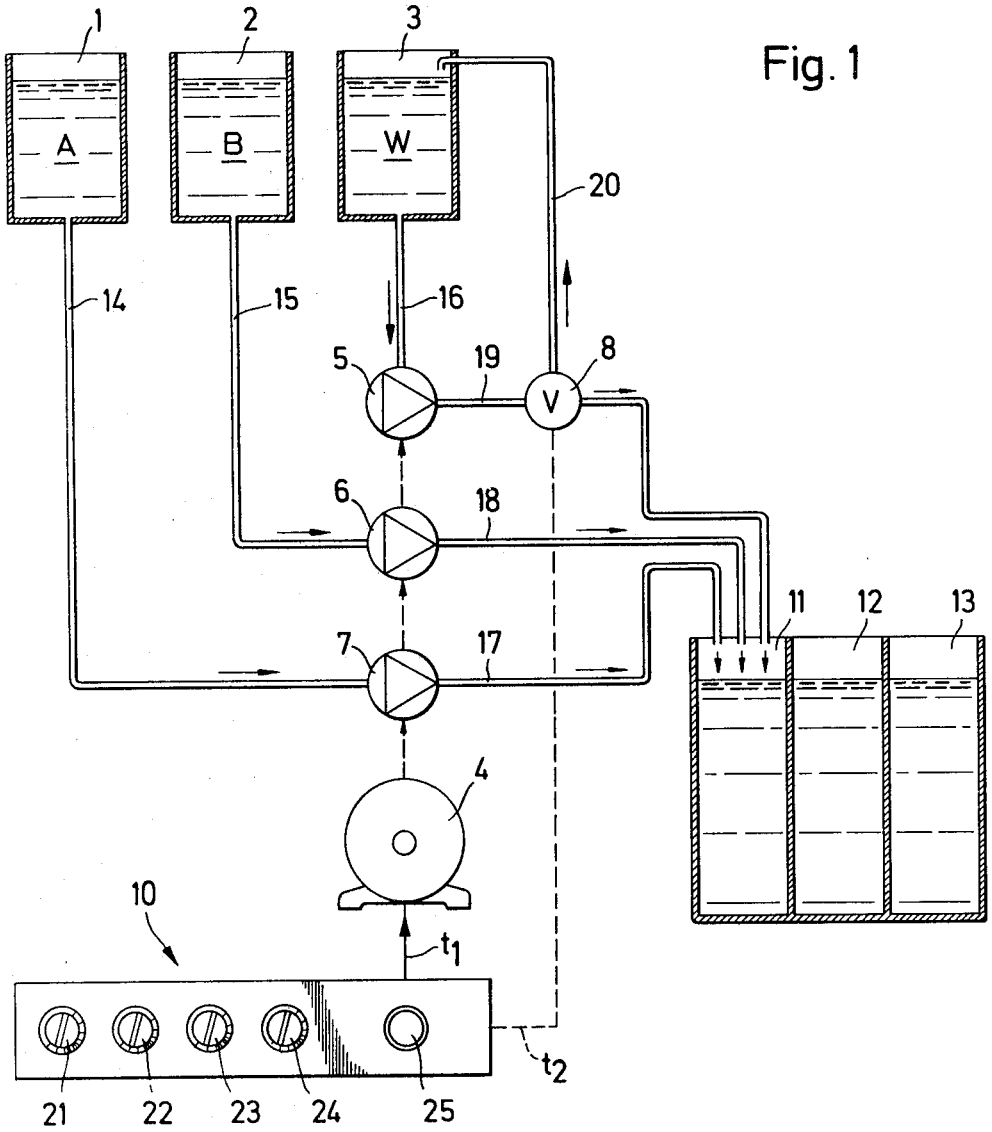
FIG. 1 is a diagram of a device for carrying out the method in accordance with this invention.

As shown in the drawings, the device comprises three storage vessels, 1,2, 3 for concentrate A, concentrate B and water for dilution W, three proportioning pumps 5,6,7 driven by a common motor 4; a three-way valve 8, a control system 10 for motor 4 and valve 8, and a processing machine comprising a developer tank 11, a fixing agent tank 12 and a washing tank 13.

The regenerating concentrates A and B and the water W are conveyed from containers 1,2,3 through lines 14, 15, 16, pumps 7, 6, 5 and additional lines 17, 18, 19 to the developer tank 11. The input and one output of valve 8 are in line 19. Its other output is connected to a line 20 which when the 3-way valve is inoperative, returns the water to the water reservoir 3.

The control system 10 comprises first adjusting means 21, 22, 23 for allowing for the area of film, the exposed portion and the film characteristics (the amount of silver per unit area), a second adjusting means 24 allowing for the machine throughput, and a start button 25. System 10 generates pulses $t_1$ and $t_2$ which actuate the motor 4 and consequently the three proportioning pumps during a time $t_1$ and actuate the three-way valve during a time $t_2$, during which time the regenerator concentrates and the water can flow from vessel 3 into tank 11.

The second adjusting means 24 is used to adjust the lengths of pulses $t_1$ and $t_2$ in opposite directions. System 10 is designed so that when means 24 is in the position corresponding to maximum throughput of the machine, the lengths of pulses $t_1$ and $t_2$ are equal to one another and to a basic control pulse $t_0$, when the regenerator is most highly diluted.

The required length of the basic control pulse $t_0$ follows directly from the capacity of the proportioning pumps and the constant total quantity A+B+W of regenerator fluid required at a given time. This total quantity is an empirical value and, as previously mentioned, depends inter alia on the characteristics (the silver content) S, the exposed portion E and the area F of film material being processed. $t_0$ is chosen in accordance with the maximum expected dilution of the regenerator fluid, i.e. when the three-way valve is actuated all the time the pumps are switched on, so that no water is recirculated through line 20. In that case, the proportion of regenerating concentrate to water (A+B):W is at a minimum and will hereinafter be called X. This ratio is adjusted by suitably dimensioning or adjusting the proportioning pumps.

Means 24 is used for increasing the proportion of regenerating concentrate (A+B) to the water W, depending on the machine throughput. To this end, pulse $t_2$ can be shortened relative to $t_0$ by a factor Z adjustable in five steps between 1 and approximately 0.85 by means 24, i.e.

$$t_2 = t_0 \cdot Z \quad 0.85 \leqq Z \leqq 1 \qquad \text{(I)}$$

To ensure that the aforementioned total amount A+B+W of regenerating fluid remains constant, the duration of pulse $t_1$ must satisfy the following condition:

$$t_1 = t_0 \cdot (1 + 1/X - Z/X) \qquad \text{(II)}$$

In the special case of maximum dilution, i.e. Z=1, conditions (I) and (II) for $t_1$ and $t_2$ return to $t_1 = t_2 = t_0$.

Figure 2:
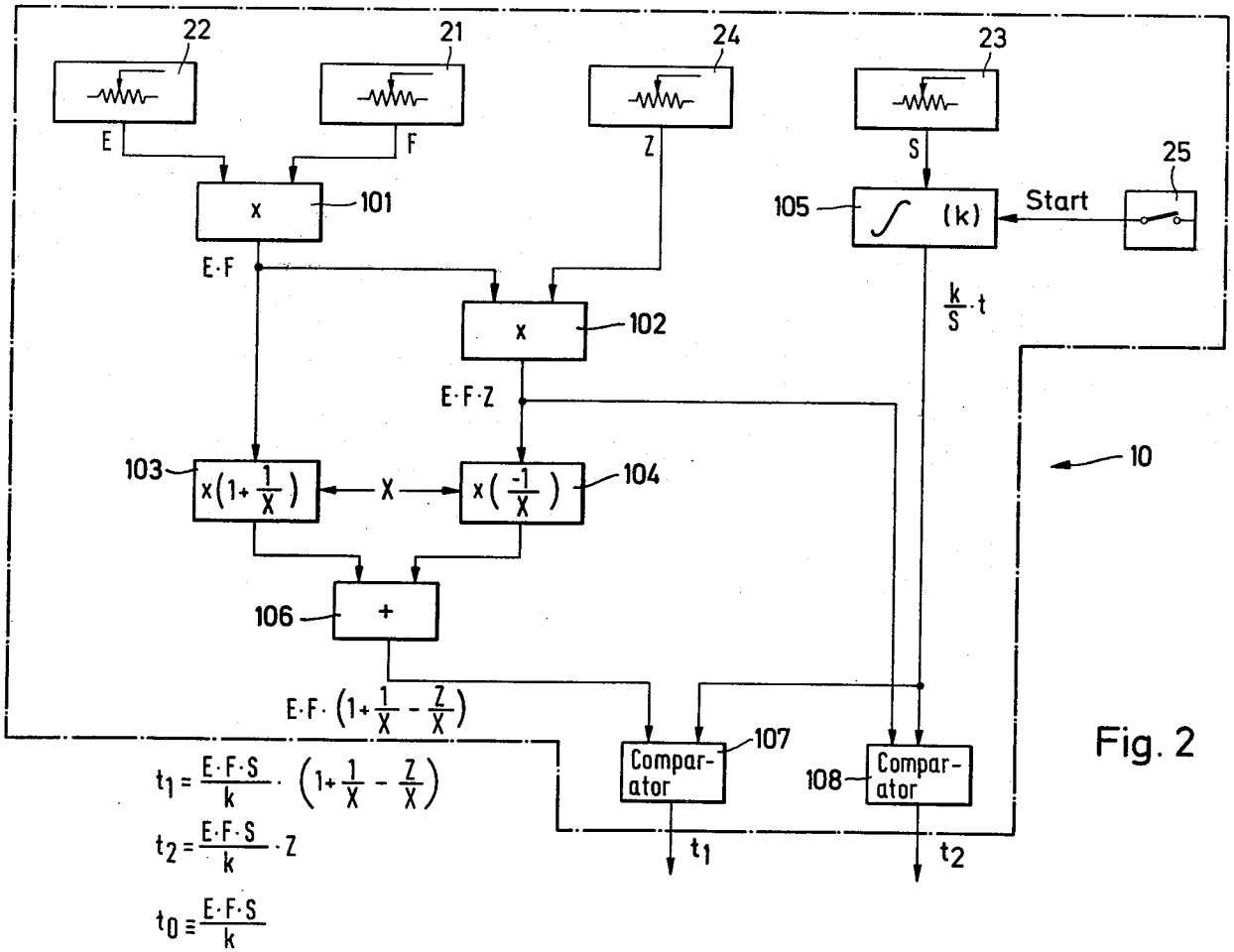
FIG. 2 is a block circuit diagram of the control system of the device shown in FIG. 1.

FIG. 2 shows a block circuit diagram of control system 10. It comprises the aforementioned start button 25 and means 21 to 24 and four multipliers 101 to 104, an integrator 105, an adder 106 and two comparators 107 and 108.

To simplify the drawing, the input means are denoted by potentiometer signs. Potentiometers can be used for continuously inputting the area F of processed material, the exposed portion E, the type of film S and the throughput Z. In practice, however, step switches have been found a completely adequate substitute for potentiometers and are even more advantageous in some cases.

Multipliers 101 and 102 produce the products E.F. and E.F.Z. from the input variables E,F and Z. Multipliers 103 and 104 multiply these products by the terms (1+1/x) and (−1/x), the values of x usually being fixed in accordance with their definition given previously. The output signals of multipliers 103 and 104 are summed in adder 106 and then supplied to an input of comparator 107. The output signal of multiplier 102 is conveyed to an input of the second comparator 108.

The input means 23 (film type S) goes immediately into the time constant of integrator 105. After being reset by button 25, integrator 105 integrates a constant signal such that its output signal is k·t/s, wherein k represents all system constants of integrator 105 and t denotes time. The output signal is supplied to the second inputs of comparators 107 and 108 and is compared with the output signals of adder 106 and multiplier 102.

If a piece of photographic material for developing is fed into the machine, the film type S, the area F and the exposed portion E are set and button 25 is pressed. If desired, the start pulse can be triggered automatically by a microswitch or the like whenever a piece of film is introduced. The estimated machine throughput Z during the day is set at the beginning of the day. After the integrator has been released by the button its output signal is zero, i.e. the comparator outputs become positive and thus actuate proportioning pumps and the solenoid valve via servo-amplifiers (not shown). As soon as the integrator output voltage k·t/s becomes as great as the voltages applied to the other comparator inputs, the comparator in question flips over and thus puts an end to pulses $t_1$ and $t_2$, thus inactivating the proportioning pumps or the solenoid valve. The comparators remain in the same state until they are again flipped by actuating the start button.

As FIG. 2 shows, the durations of pulses $t_1$ and $t_2$ are:

$$t_1 = E \cdot F \cdot S/k \; (1 + 1/X - Z/X) \qquad \text{(III)}$$

$$t_2 = E \cdot F \cdot S \cdot /k \cdot Z \qquad \text{(IV)}$$

If E·F·S·/k is denoted by $t_0$, these formulae merge directly into formulae (I) and (II).

Of course, the integrator system constants k must be designed so that the required proportioned volume is obtained if the feed pumps are suitably dimensioned. This, however, does not have to be spelt out to the skilled addressee.

In the prior art methods, the activity of lith developers can be kept constant only by continuous, expensive monitoring of the bath activity or operating conditions, allowance also being made for the time in use. It has surprisingly been found that the method according to the invention and the device for performing the method can obtain the same result in simple manner, by varying only the dilution of the regenerator fluid or the amount of diluting water added with the concentrates, in dependence on the machine throughput.

The direct use of concentrates and direct supply of water to the processing tank also simplifies the processing work, in that there is no need to prepare dilute regenerator solutions from the components or the concentrates.

The following example will illustrate the method and operation of the device according to the invention. Of course, it is not intended to restrict the invention to the composition of the components given in the examples.

EXAMPLE

A photographic high-contrast material containing a silver halide emulsion film containing 6 grams of developable silver (i.e. 70 mol % silver chloride and 30 mol % silver bromide) per $m^2$ emulsion, was exposed in conventional manner, after which individual sheets of the material were supplied to a continuous processing machine.

The first tank of the machine contained 64 liters of a developing solution containing the following substances per liter:

| | |
|---|---|
| Hydroquinone | 15 g |
| Triethylene glygol | 40 g |
| Sodium sulphite | 2.5 g |
| Sodium formaldehyde bisulphite | 50 g. |
| Sodium carbonate | 33 g |
| Sodium metaborate | 1.5 g |
| EDTA tetrasodium salt | 1.5 g |
| Diethanolamine | 25 g |
| Potassium bromide | 2 g |
| Potassium hydroxide | approx. 3 g *) |

-continued

| | |
|---|---|
| Water | Made up to 1 liter |

*) The amount of potassium hydroxide was chosen so that the pH of the developing solution was exactly 10.2.

The developing time was 1.8 min. at a temperature of 25° C.

In order to keep the activity of the solution constant for a long period, a regenerator solution having the following composition was added whenever a new sheet was placed in the machine:

Regenerator Concentrate A

| | |
|---|---|
| Hydroquinone | 120 g |
| Triethylene glycol | 400 g |
| Sodium sulphite | 40 g |
| Sodium formaldehyde bisulphite | 300 g |
| Boric acid | 9 g |
| Water | Made up to 1 liter |

Regenerator Concentrate B

| | |
|---|---|
| Sodium carbonate | 200 g |
| EDTA tetrasodium salt | 9 g |
| Diethanolamine | 150 g |
| Potassium hydroxide | Approx. 20 g *) |
| Water | Made up to 1 liter |

*) The amount of potassium hydroxide was made such that the pH of the 1:1:4 (A:B:water) dilute regenerator was 10.3.

1 liter of dilute regenerator solution was added to the developer for each square meter of exposed surface of photographic material. Components A and B were diluted with water in accordance with the following Table, in dependence on the machine throughput. According to the invention, components A and B and the water were introduced individually, simultaneously and in equal portions into the developing tank, using a proportioning pump in each case.

TABLE I

| Machine throughput per 24 hours | | | | | |
|---|---|---|---|---|---|
| Exposed Surface in $m^2$ | Volume of regenerator as % of tank contents | $z = \frac{t}{t_0}$ | Composition of regenerator A | : B | : W |
| 38.4 | ≧60 | 1.00 | 1.00 | 1.00 | 4.00 |
| 28.8 | 45 | 0.98 | 1.04 | 1.04 | 3.92 |
| 19.2 | 30 | 0.94 | 1.12 | 1.12 | 3.76 |
| 9.6 | 15 | 0.90 | 1.20 | 1.20 | 3.60 |
| 6.4 | 10 | 0.87 | 1.26 | 1.26 | 3.48 |

If the machine is expected to stop more than 48 hours after the heating (for keeping the developing agent at a predetermined temperature) has been switched off and without circulating the developing agent, 160 ml of each concentrate A and B (i.e. 0.25% of the tank contents) will be poured into the tank after each 24 idle hours.

Provided the developing time and temperature are kept constant, the results obtained by this method remain unchanged even after six months.

What is claimed is:

1. A method of regenerating and maintaining the activity of a lith developing solution in a continuous processing machine intermittently supplied with exposed photographic material, comprising adding a regenerator comprising at least a first and a second stable regenerating concentrate and diluting water, said first concentrate essentially containing, at a pH below 7, hydroquinone, sulphite and sodium formaldehyde bisulphite and said second concentrate essentially containing, at a pH higher than 7, alkali, buffer substances and, optionally, complexing agents and aromatic amines, both said first and said second concentrates being substantially free from bromine ions, to the lith developing solution either before, simultaneously with, or subsequent to the introduction of the photographic material in a quantity which is proportional to the unit exposed surface of the given photographic material; the relative proportion of said concentrates and the quantity of regenerator per unit exposed surface of the given photographic material being kept constant, while the volume proportion between both said concentrates and said diluting wate is varied according to a given throughput of photographic material during a given period of time such that the degree of dilution is lower if the throughput is relatively small and higher if the throughput is relatively large.

2. The method according to claim 1, wherein the degree of dilution is at a maximum when the daily minimum throughput corresponds to a regenerator-fluid consumption of 60% or more of the contents of the developer tank, whereas when the throughtput is lower, the degree of dilution is lowered in a number of steps, corresponding to throughput ranges, to a minimum corresponding to the lowest expected throughput.

3. The method according to claim 2, wherein the maximum degree of dilution is approximately 6 parts diluting water to 2 parts concentrates.

4. The method according to claim 3, wherein the minimum degree of dilution is approximately 6 parts diluting water to 2.5–3 parts concentrates.

5. The method according to claim 1, wherein when the processing machine has remained inoperative for an extended period, said concentrates are added without diluting water in a quantity such as to compensate for the loss of activity per unit time in the developing solution during said extended period so that the photographic activity of the developing solution remains substantially constant.

* * * * *